US007080502B2

(12) United States Patent
Stahlecker

(10) Patent No.: US 7,080,502 B2
(45) Date of Patent: Jul. 25, 2006

(54) ARRANGEMENT FOR PRODUCING A SPUN THREAD

(75) Inventor: Gerd Stahlecker, Eislingen/Fils (DE)

(73) Assignee: Maschinenfabrik Rieter AG, Winterthur (CH)

( * ) Notice: Subject to any disclaimer, the term of this patent is extended or adjusted under 35 U.S.C. 154(b) by 250 days.

(21) Appl. No.: 10/736,910

(22) Filed: Dec. 17, 2003

(65) Prior Publication Data

US 2005/0204720 A1 Sep. 22, 2005

(30) Foreign Application Priority Data

Dec. 17, 2002 (DE) ..... 102 61 011

(51) Int. Cl.
*D01H 4/02* (2006.01)

(52) U.S. Cl. ..... 57/315; 57/350

(58) Field of Classification Search ..... 57/313, 57/333, 350; 28/283
See application file for complete search history.

(56) References Cited

U.S. PATENT DOCUMENTS

| | | | | |
|---|---|---|---|---|
| 4,837,117 | A * | 6/1989 | Armiger et al. | 428/392 |
| 5,159,806 | A | 11/1992 | Mori et al. | |
| 5,295,349 | A | 3/1994 | Okamoto | |
| 5,927,062 | A * | 7/1999 | Deno et al. | 57/333 |
| 6,209,304 | B1 | 4/2001 | Feuerlohn et al. | |

FOREIGN PATENT DOCUMENTS

| | | |
|---|---|---|
| EP | 0854214 | 7/1998 |
| EP | 1 329 542 | 7/2003 |

* cited by examiner

*Primary Examiner*—Shaun R. Hurley
(74) *Attorney, Agent, or Firm*—Crowell & Moring LLP

(57) ABSTRACT

An arrangement for manufacturing a spun thread from a staple fiber mass includes a feed channel having an outlet opening for feeding the fiber mass, and a yarn withdrawal channel having an inlet opening. In order to generate a rotating current around the entry opening of the yarn withdrawal channel, a vortex chamber is provided with compressed air nozzles. An air evacuation duct surrounds, essentially ring-like, a stationary, spindle-shaped component which forms the yarn withdrawal channel. The feed channel extends in a meandering manner and includes fiber guiding surfaces, which are designed in the form of deflecting edges, between which the staple fiber mass is without support.

22 Claims, 2 Drawing Sheets

Fig. 2
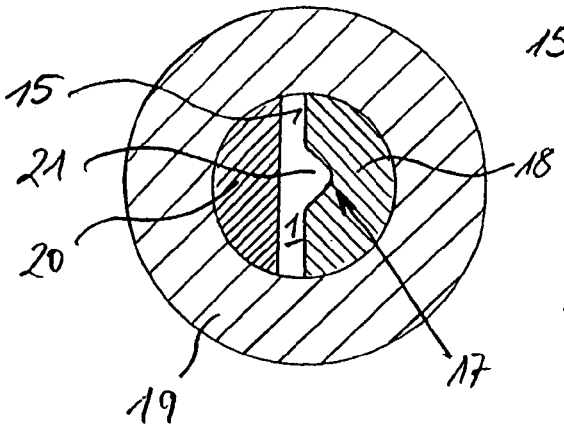
Fig. 3
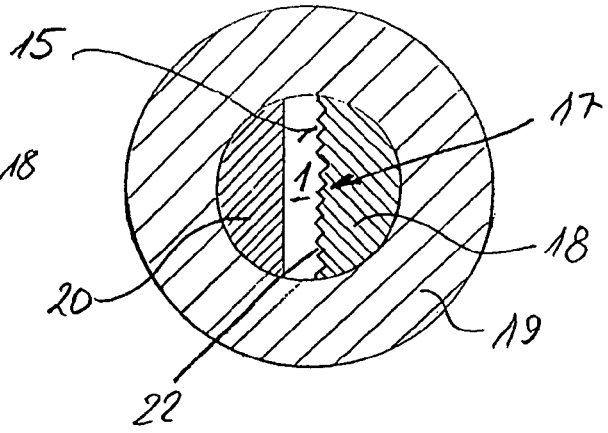
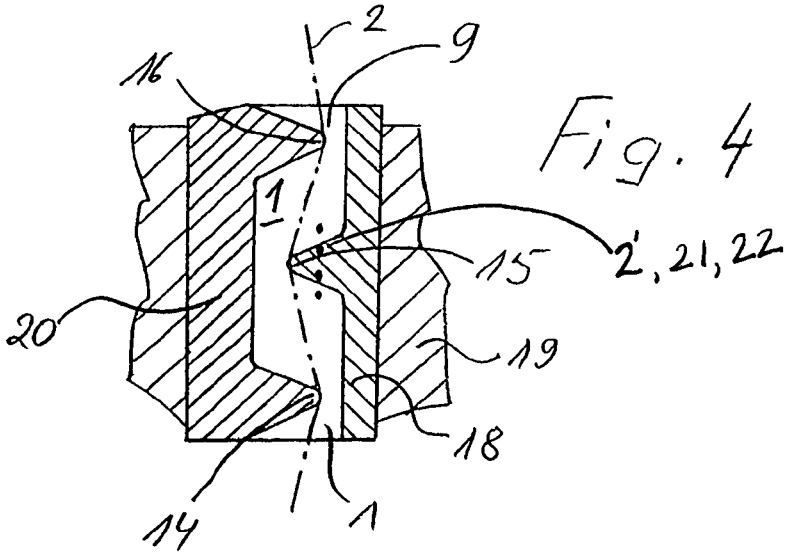
Fig. 4

ARRANGEMENT FOR PRODUCING A SPUN THREAD

BACKGROUND AND SUMMARY OF THE INVENTION

This application claims the priority of German Application No. 102 61 011.8 filed Dec. 17, 2002, the disclosure of which is expressly incorporated by reference herein.

The present invention relates to an arrangement for producing a spun thread from a staple fiber mass, comprising a feed channel having an outlet opening for feeding the staple fiber mass, a stationary, spindle-shaped component arranged downstream of the outlet opening having a yarn withdrawal channel comprising an inlet opeing, a vortex chamber connected to compressed air nozzles and located between the outlet opening and the inlet opening for generating a rotating current around the inlet opening, an air evacuation duct surrounding, essentially ring-like, the spindle-shaped component, and fiber guiding surfaces deflecting the staple fiber mass for forming a twist block.

An arrangement of this type is prior art in European published patent 854 214. In this arrangement, a staple fiber mass, leaving a drafting unit, is guided through a feed channel to the inlet opening of a yarn withdrawal channel, whereby initially the front ends of the fibers contained in the staple fiber mass are guided into the yarn withdrawal channel, while the free rear fiber ends are spread apart and seized by the rotating current and twisted around the already bound-in front ends located in the inlet-opening of the yarn withdrawal channel, thus generating a thread having to a great extent a real twist.

Around the area of the inlet opening, a regular "sun" is formed by the circling fibers due to the rotating air current, some of which fibers are also wound around the spindle-shaped component.

In the case of the known arrangement, helical-shaped fiber guiding surfaces are provided as twist blockers, whereby the helix has the same direction of rotation as the rotating air current and extends over a peripheral angle of between 90° and 120°. The helix is formed by means of an insert in a tube and thus fills out approximately half the cross section of the tube, whereby the remaining empty area of the cross section forms the feed channel. The fibers of the staple fiber mass are disposed continuously in the feed channel on this helix.

It is an object of the present invention to increase and intensify the action of the twist block in a system of the above referred to type.

This object is achieved in accordance with certain preferred embodiments of the present invention in that the feed channel extends in a meandering manner, and in that the fiber guiding surfaces are designed as deflecting edges, between which the staple fiber mass is without any support.

Because of the meandering extent of the feed channel and because of the deflecting edges, which can be of any number, a very effective twist block is achieved, which develops gradually from a zero effect to a very intensive twist block. Because the staple fiber mass is without any support between the deflecting edges, fibers can loosen and spread out in these areas so that at a later stage in the vortex chamber, they are available as circulating fibers around the core fibers.

According to certain preferred embodiments of the present invention, it is provided that the last deflecting edge in the travel direction of the staple fiber mass is arranged eccentrically to the inlet opening of the yarn withdrawal channel. This increases the effect of the last deflecting edge, in particular when this is arranged in direct proximity to the inlet opening of the yarn withdrawal channel.

According to certain preferred embodiments of the present invention, in order to keep the twist block as compact as possible, only three deflecting edges are provided.

According to certain preferred embodiments of the present invention, it can be provided that at least one deflecting edge is additionally provided with a profile. The effect of the twist block can thus be intensified even further. In the case of said profile, at least one wedge-shaped groove, arranged in travel direction of the staple fiber mass can be involved, by means of which the individual fibers of the staple fiber mass separate and are nipped in a certain way. Alternatively, a plurality of very small notch-like grooves can provided, which serve the same purpose.

BRIEF DESCRIPTION OF THE DRAWINGS

These and further objects, features and advantages of the present invention will become more readily apparent from the following detailed description thereof when taken in conjunction with the accompanying drawings wherein:

FIG. 2 is, even further enlarged, a sectional view along the plane II—II of FIG. 1;

FIG. 3 is a sectional view similar to FIG. 2 showing another embodiment of the present invention; and FIG. 4 is an enlarged partial view of FIG. 1 in the area of the twist block.

DETAILED DESCRIPTION OF THE DRAWINGS

Figure 1:
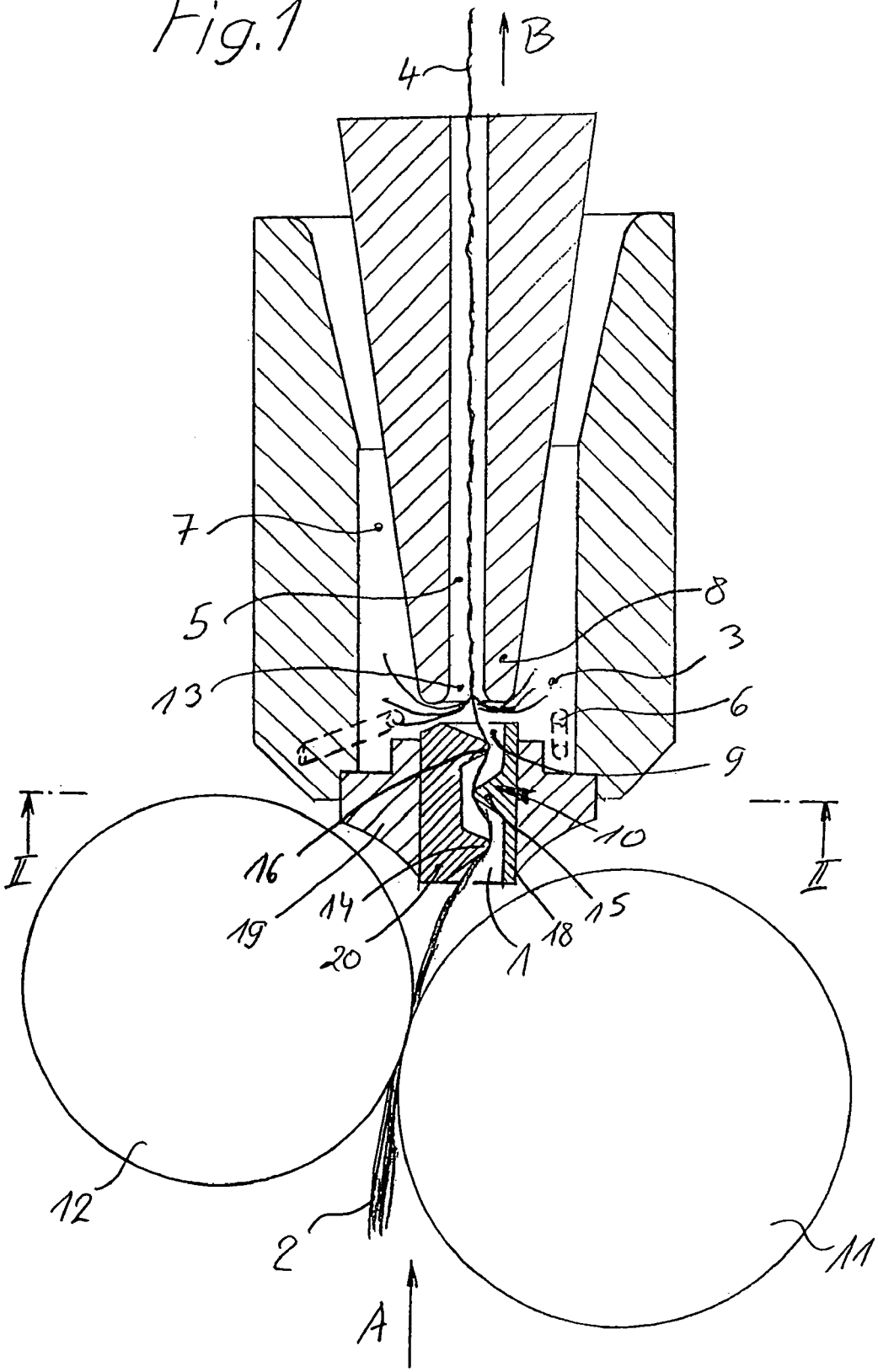
FIG. 1 is, approximately ten times enlarged, a longitudinal sectional view of an arrangement according to the present invention.

FIG. 1 shows an arrangement in which a loose staple fiber mass 2, guided through a feed channel 1 in direction of motion A, receives a twist in a vortex chamber 3, so that a spun thread 4 forms which is then withdrawn through a yarn withdrawal channel 5 in delivery direction B. A fluid device generates a rotating air current in the vortex chamber 3 by means of blowing in pressurized air through compressed air nozzles 6 which discharge tangentially into the vortex chamber 3. The exiting air is guided off through an air evacuation duct 7, whereby the duct 7 comprises a ring-shaped cross section around a spindle-shaped stationary component 8, in which the yarn withdrawal channel 5 is arranged.

In the area of the outlet opening 9 of the feed channel 1, a twist block 10 is provided which is described in more detail below.

In the arrangement shown, the fibers to be spun coming from a delivery roller pair 11,12 are, on the one hand, held in said staple fiber mass 2 and are thus guided from the outlet opening 9 of the feed channel 1 essentially without twist into the yarn withdrawal channel 5. On the other hand, the fibers in the area between the feed channel 1 and the yarn withdrawal channel 5 are subject to the influence of the rotating air current, by means of which they, or least their end areas, are radially driven away from the inlet opening 13 of the yarn withdrawal channel 5. The threads 4 produced by the described process comprise therefore a core of fibers or fiber areas extending essentially in thread longitudinal direction, without any essential twist and an outer area, in which the fibers or fiber areas are wound around the core.

Basing the formation of the thread structure on an idealized process for the purposes of greater clarity, it can be said that the structure of the thread 4 forms because the front running ends of the fibers, in particular those whose rear areas are held upstream by the feed channel 1, essentially reach the yarn withdrawal channel 5 directly, whereas the fiber areas following behind, in particular when they are no longer held in the entry area to the feed channel 1, are pulled out of the staple fiber mass 2 due to the rotating air current and then are twisted around the forming thread 4. In any case, fibers are bound into the forming thread 4, whereby they are pulled through the yarn withdrawal channel 5, and are simultaneously subject to the effects of the rotating current, which centrifugally accelerate the fibers, that is from the inlet opening 13 of the yarn withdrawal channel 5 onwards, from where they are sucked into the air evacuation duct 7.

The fiber areas pulled from the staple fiber mass 2 because of the rotating air current form a fiber swirl which travels into the entry opening 13 of the yarn withdrawal channel 5, the longer parts of which fiber swirl wind themselves, spiral-like, around the spindle-shaped component 8, which spiral is pulled towards the entry opening 13 of the yarn withdrawal channel 5 against the force of the current in the air evacuation duct 7.

As can be seen in FIG. 1 and in particular from the larger than actual size depiction in FIG. 4, fiber guiding surfaces are provided in the feed channel 1, which surfaces deflect the staple fiber mass 2 for the formation of the twist block 10. The feed channel 1 extends hereby in a meandering manner, and the fiber guiding surfaces are additionally designed as deflecting edges 14,15 16, between which the staple fiber mass 2 is without any support. This staple fiber mass 2 is denoted only by a dot-dash line in FIG. 4, and it can be seen that it is disposed only on the deflecting edges 14,15 and 16 on the fiber guiding surfaces.

This embodiment, in comparison to prior art, results in the advantage that the twist block 10 is very intensive while at the same time increasing its effect from the first deflecting edge 14 to the last deflecting edge 16.

As can be seen in particular from FIG. 1, the last deflecting edge 16 extends in travel direction A of the staple fiber mass 2 eccentrically to the entry opening 13 of the yarn withdrawal channel 5 and is disposed in direct proximity to this entry opening 13. Three deflecting edges 14,15 and 16 are provided overall.

As can be seen in FIGS. 2 and 3, at least one deflecting edge 15 can comprise in addition a profile 17, by means of which the effect of the twist block 10 is again increased. The profile 17 is a component part of an insert 18, comprising the deflecting edge 15, which is located in a supporting tube 19, see also FIG. 1, whereby in order to form the twist block 10, a second insert 20 is arranged to the insert 18, which second insert 20 in turn comprises the deflecting edges 14 and 16.

According to FIG. 2, the profile 17 is designed as a wedge-shaped groove 21, while according to FIG. 3 the profile 17 consists of a plurality of notch-like grooves 22. FIG. 4 shows in dotted lines a path 2' of the fiber mass with the schematically depicted groove 21 and grooves 22. This results in the fibers belonging to the staple fiber mass 2 being separated better and, in certain cases, being nipped in, which increases the effect of the twist block 10.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for producing a spun yarn from a staple fiber mass, comprising:

a feed channel having an outlet opening for feeding the staple fiber mass, a stationary, spindle-shaped component arranged downstream of the outlet opening having a yarn withdrawal channel comprising an inlet opening, a vortex chamber connected to compressed-air nozzles and located between the outlet opening and the inlet opening for generating an eddy current around the inlet opening, an air evacuation duct surrounding, essentially in a ring form, the spindle-shaped component, and fiber guiding surfaces deflecting the staple fiber mass for forming a twist block, wherein the feed channel extends in a meandering manner, wherein the guiding surfaces are designed as deflecting edges, between which the staple fiber mass is without any support, and wherein the last deflecting edge in a direction of motion of the staple fiber mass is arranged eccentrically to the inlet opening of the yarn withdrawal channel.

2. An arrangement according to claim 1, wherein the last deflecting edge is arranged in direct proximity of the inlet opening.

3. An arrangement according to claim 1, wherein three deflecting edges are provided overall.

4. An arrangement according to claim 2, wherein three deflecting edges are provided overall.

5. An arrangement according to claim 1, wherein at least one deflecting edge is provided additionally with a profile.

6. An arrangement according to claim 5, wherein the profile comprises at least one wedge-shaped groove in the direction of motion of the staple fiber mass.

7. An arrangement according to claim 6, wherein a plurality of notch-like grooves are provided.

8. An arrangement according to claim 2, wherein at least one deflecting edge is provided additionally with a profile.

9. An arrangement according to claim 8, wherein the profile comprises at least one wedge-shaped groove in the direction of motion of the staple fiber mass.

10. An arrangement according to claim 9, wherein a plurality of notch-like grooves are provided.

11. An arrangement according to claim 3, wherein at least one deflecting edge is provided additionally with a profile.

12. An arrangement according to claim 11, wherein the profile comprises at least one wedge-shaped groove in the direction of motion of the staple fiber mass.

13. An arrangement according to claim 12, wherein a plurality of notch-like grooves are provided.

14. A method of making yarn using the apparatus of claim 1, comprising feeding a staple fiber mass to the feed channel and withdrawing yarn from the yarn withdrawal channel.

15. Apparatus for spinning yarn comprising:

a fiber feed channel having a feed channel outlet opening, a yarn withdrawal channel disposed downstream of the fiber feed channel with a yarn withdrawal channel inlet opening facing the feed channel outlet opening, and vortex air means for generating an eddy current round the yarn withdrawal inlet opening to thereby wind outer fibers of the fiber mass around a core section of the fiber mass as the fiber mass travels from the fiber feed channel to the yarn withdrawal channel, wherein the fiber feed channel includes deflecting edges engageable with the staple fiber mass to deflect the staple fiber mass so it travels in a meandering path through the fiber feed channel, said deflecting edges being spaced along the veil travel path length of the fiber feed channel such that the fiber mass in unsupported by and spaced from walls of the fiber feed channel at positions intermediate the deflecting edges, and wherein the last deflecting edge in a direction of motion of the staple fiber mass is arranged eccentrically to the inlet opening of the yarn withdrawal channel.

16. Apparatus according to claim 15, wherein the last deflecting edge in a direction of motion of the staple fiber mass is arranged eccentrically to the inlet opening of the yarn withdrawal channel.

17. Apparatus according to claim 16, wherein the last deflecting edge is arranged in direct proximity of the inlet opening.

18. Apparatus according to claim 16, wherein three deflecting edges are provided overall.

19. Apparatus according to claim 17, wherein three deflecting edges are provided overall.

20. Apparatus according to claim 19, wherein the profile comprises at least one wedge-shaped groove in the direction of motion of the staple fiber mass.

21. Apparatus according to claim 20, wherein a plurality of notch-like grooves are provided.

22. A method of making yarn comprising:

feeding a fiber mass to a fiber mass feed channel having a feed channel outlet opening, withdrawing spun yarn from a yarn withdrawal channel disposed downstream of the fiber mass feed channel with a yarn withdrawal channel inlet opening facing the feed channel outlet opening, and applying vortex air to the fiber mass using vortex air means for generating an eddy current round the yarn withdrawal inlet opening to thereby wind outer fibers of the fiber mass around a core section of the fiber mass as the fiber mass travels from the fiber mass feed channel to the yarn withdrawal channel, wherein the fiber mass feed channel includes deflecting edges engageable with the staple fiber mass to deflect the staple fiber mass so it travels in a meandering path through the fiber mass feed channel, said deflecting edges being spaced along the veil travel path length of the fiber mass feed channel such that the fiber mass in unsupported by and spaced from walls of the fiber mass feed channel at positions intermediate the deflecting edges, and wherein the last deflecting edge in a direction of motion of the staple fiber mass is arranged eccentrically to the inlet opening of the yarn withdrawal channel.

* * * * *